United States Patent [19]

Gilman

[11] Patent Number: 4,666,482

[45] Date of Patent: May 19, 1987

[54] PROCESS FOR SOLIDIFYING SOLVENT REFINED COAL

[75] Inventor: Harris H. Gilman, Grand Junction, Colo.

[73] Assignee: Electric Power Research Institute, Palo Alto, Calif.

[21] Appl. No.: 819,232

[22] Filed: Jan. 15, 1986

[51] Int. Cl.[4] ..... F25J 5/00

[52] U.S. Cl. ..... 62/12; 62/63; 62/71; 62/346; 165/104.18; 264/13

[58] Field of Search ..... 165/104.18; 62/63, 71, 62/340, 12, 346; 264/5, 13, 28, 39

[56] References Cited

U.S. PATENT DOCUMENTS

| | | | |
|---|---|---|---|
| 2,872,386 | 2/1959 | Aspegren | 165/104.18 |
| 3,254,881 | 6/1966 | Rusk | 165/104.18 |
| 3,459,638 | 5/1969 | Nagel | 203/7 |
| 3,627,036 | 12/1971 | Gilbert | 165/104.18 |
| 3,816,572 | 6/1974 | Roelofs | 264/28 |
| 3,841,994 | 10/1974 | Wunderlich et al. | 208/11 |
| 3,843,462 | 10/1974 | Phillips | 203/11 |
| 3,844,930 | 10/1974 | Wunderlich et al. | 208/11 |
| 3,912,431 | 10/1975 | Ellithorpe et al. | 62/71 |
| 4,077,849 | 3/1978 | Ziehm, Jr. | 202/205 |
| 4,104,101 | 8/1978 | Naef | 165/108.18 |
| 4,260,456 | 4/1981 | Schulman | 201/12 |
| 4,273,101 | 6/1981 | Merges | 165/104.18 |

FOREIGN PATENT DOCUMENTS

| | | | |
|---|---|---|---|
| 479984 | 7/1929 | Fed. Rep. of Germany | 62/12 |

*Primary Examiner*—Ronald C. Capossela

*Attorney, Agent, or Firm*—Flehr, Hohbach, Test, Albritton & Herbert

[57] ABSTRACT

A method and apparatus is provided for efficiently solidifying solvent-refined coal whereby the hot solvent-refined coal in liquid form is contacted in a cooling zone with dry, inert, heat absorbent particulate solids within a rotating structure. The liquid solvent refined coal is solidified upon the particulate solids, separated by abrasion and friction within a separating zone, and the particulate solids are cooled and recycled back into the cooling zone for contact with a fresh supply of liquid solvent refined coal.

6 Claims, 1 Drawing Figure

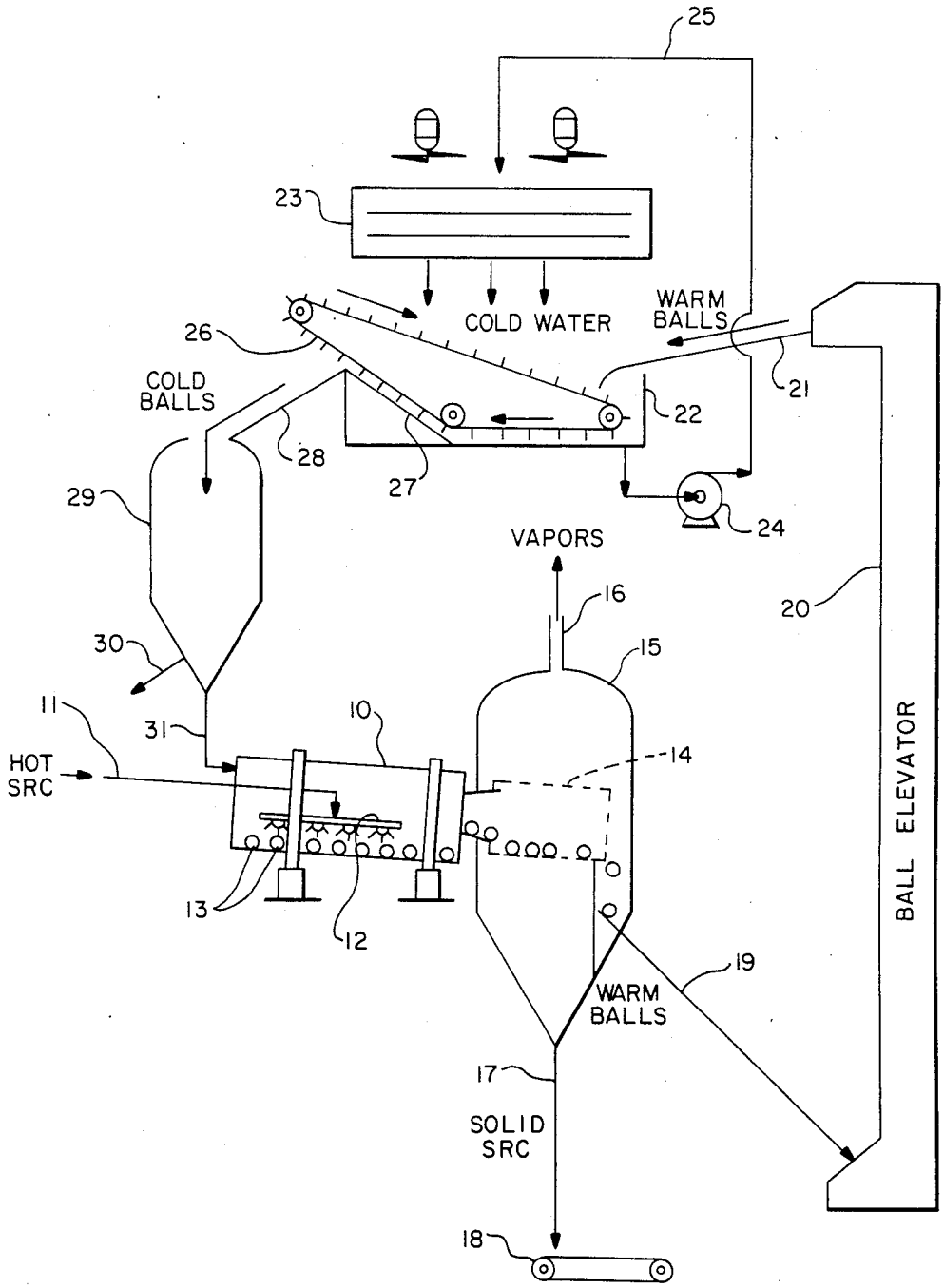
25
23
COLD WATER
WARM BALLS
26
21
COLD BALLS
22
28
27
29
24
VAPORS
16
20
30
15
11
10
31
14
HOT SRC
BALL ELEVATOR
13
12
19
WARM BALLS
17
SOLID SRC
18

PROCESS FOR SOLIDIFYING SOLVENT REFINED COAL

The present invention is directed to an improved method for solidifying liquid solvent refined coal.

In many industrial processes there is a step which requires the solidification of hot liquids. There is machinery known in the art, commonly called flakers, which accomplish this and usually involve providing a cooled smooth surface such as a rotating cooled drum, a continuous cooled metal belt or a plurality of cooled flat pans, which solidify the hot liquid when coming into contact with it. The solid is then usually removed from the cooled surface by flexing, scraping (such as by a knife blade), or other abrading means. The solid is then usually discharged from the machine, whereby the cooled surface is ready for another charge of hot liquid material.

A disadvantage of the above types of available machines when used for solidifying liquid solvent refined coal (SRC) is that such available machines, by providing a large smooth surface, are not economical because of the size of equipment which would be required. Also, due to the expulsion of hot noxious fumes during the solidification of SRC, the environmental control of these fumes, as well as the complexity of the controls required, such as the piping, fume ducts, etc., substantially increases the product cost. Furthermore, the solidification of SRC requires that the final product (solid SRC) not be wet at the end of the process. Therefore, if the cooling system for cooling the liquid SRC involves direct contact with water, then a product drying system must be included, which adds to the capital expense of the system. The cooling system for large flat surfaces can further complicate the mechanical design and reliability of the system, especially in cold climates where extensive winterizing provisions are necessary to protect the cooling water.

Further it has been found that by using a conventional flaker involving a large cooled surface, due to the relatively low thermal conductivity of SRC, large smooth surfaces can only accommodate a thin coating of the liquid SRC since a thick coating of the SRC insulates the cold surface, therefore prolonging the hardening time. It has thus been found that in order to utilize conventional flakers in an SRC production plant, a large number of cooling machines are required in order to provide sufficient total heat transfer area to meet the needs of the plant, which may be as high as several thousand tons per day of SRC. Furthermore the operating costs of such conventional coolers, complicated by the distribution of the cooling water to and from each machine as well as the elaborate methods required to collect the noxious fumes from each machine for treatment, are disadvantages.

Therefore a more efficient and inexpensive method of solidifying solvent refined coal is needed.

It is therefore an object of the present invention to provide an improved apparatus method for efficiently solidifying solvent refined coal.

These and other objects of the invention will become apparent to those skilled in the art from the following description of the preferred embodiments and from the appended claims.

The present invention provides a method for efficiently solidifying solvent refined coal comprising the steps of providing solvent refined coal in a substantially liquid form at a temperature in the range of 200° to 600° F. and contacting the liquid SRC with dry, substantially inert heat-absorbent particulate solids which are initially provided at a temperature less than 200° F., in a cooling zone within a rotating structure for a period of time to allow sufficient heat transfer from the SRC to the solids, thereby forming a coating of solid SRC on the particulate solids; separating the solid SRC coating from the particulate solids; collecting the separated particulate solids and cooling them to a temperature less than 200° F.; and then recycling the cooled solids to be contacted again with a fresh supply of solvent refined coal in a substantially liquid form in the cooling zone.

The accompanying figure schematically illustrates an apparatus for performing the method according to the present invention.

With reference to the accompanying drawing, there is shown a rotating drum 10 into which liquid solvent refined coal is provided through line 11. The liquid solvent refined coal is provided in its as-processed form at a temperature in the range of about 200° to 600° F., and usually within the temperature range of 350° to 450° F. As shown, the SRC is sprayed through a plurality of nozzles 12, onto dry, heat absorbent balls 13, provided at a temperature at less than 200° F. The liquid SRC tends to coat each ball with a thin layer of SRC. The cool mass of the ball reduces the temperature of the SRC coating sufficiently to the point that the SRC becomes solid. Due to the inclination of drum 10 the balls roll to the lower end of the drum, accumulate with a coating of solid SRC thereon, and then spill into rotating trommel screen 14. Trommel screen 14 has openings smaller than the size of balls 13. Trommel screen 14 is enclosed within housing 15, from which hydrocarbon vapors and other types of vapors exuded from the SRC are withdrawn for recovery, processing, and/or environmental treatment for discharge into the surroundings. The vapors are withdrawn through line 16 either with or without the assistance of an air pump (not shown). Due to the frictional forces of the balls against the walls of the trommel 14 and against each other, the coating of solidified SRC is abraded or flaked off the balls and drops to the bottom of housing 15 through withdrawing line 17 onto a conveyor 18 for collection. The collected solid SRC may be further cooled, if necessary, while traversing the conveyor 18 by exposure to ambient air and/or airflow by a fan (not shown). The warm balls from the trommel 14 from which the solid SRC has been removed are transferred by a duct, indicated by arrow 19, into a bucket elevator 20, which in turn transfers the warm balls via ramp 21 into cooling tank 22. Tank 22 contains cool water provided by an evaporative water cooler 23. The water contained in tank 22 is recirculated via pump 24 and line 25 through cooler 23 and returned to the tank 22. The balls are cooled within tank 22 and are then moved by toothed conveyor 26 along the bottom of the tank, up dewatering ramp 27 then down ramp 28 into hopper 29. Excess water is drained from hopper 29 through the draining line indicated by the arrow 30 and the cool balls are discharged back into the rotating drum through the duct indicated by arrow 31 to complete the cycle.

The particular type of heat absorbent solids utilized in accordance with the present invention may vary widely and have any desired shape. For example, the heat absorbent solids may be metal or ceramic and may have a ball-like shape. Preferably the heat absorbent solids will be balls having an average diameter in the range of 0.5 to 1.5 inch, preferably ceramic balls of approximately 1 inch in diameter. The residence time of the balls within the rotating drum 10 will depend on the length of the drum 10, the speed of rotation of the drum and method by which the liquid SRC is contacted with the balls within the drum. As shown in the accompanying figure the SRC is sprayed through nozzles onto the balls, however, the liquid SRC may also be poured onto the balls or otherwise contacted with the objective being to contact as many balls as possible with hot liquid SRC. The preferred residence time for the balls to be within the drum 10 and trommel 14 is a total of about a half an hour. A preferred residence time for the balls to remain within the cooling tank 22 is also about a half an hour. It is desirable to retain the balls within tank 22 for a period of time sufficient to cool them to a temperature below 200° F., and preferably in the range of 60° to 100° F. A preferred temperature for the balls when they exit the tank 22 and into hopper 29 is a temperature of about 80° F.

It is expected that the balls, while being retained within hopper 29 will dry in the open atmosphere merely by the result of their exposure to the atmosphere at their residual temperature, which as indicated above will usually be at least about 80° F. However, hopper 29 may be additionally equipped, if necessary, with a positive air circulation means such as a blower to assist drying.

While conventional processes which produce hot liquid SRC usually result in the SRC being at a temperature in the range of about 200° to 600° F., normally the SRC will be provided to the drum 10 at a temperature of about 350° to 450° F. By using the ceramic balls of approximately 1 inch in diameter and controlling the retention time of the balls within the drum and trommel to about half an hour, it is desirable that the warm balls exit .the housing 15 onto ramp 19 at a temperature of about 175° F. with the solid SRC exiting line 17 at about the same temperature. The solid SRC may be further cooled on conveyor 18 by air drying with or without the assistance of a blower or fan.

It may be seen from the above description of the preferred embodiments that the present invention provides a method and means for solidifying liquid SRC by which at least the following advantages are attained. Cooling is accomplished according to the present invention of the surfaces on which the SRC is solidified (balls 13) in one location (tank 22) using direct water cooling, rather than using, as with the prior art, elaborate circulating cooling water supply and return systems to remote heat transfer surfaces. Also, hydrocarbon fume collection is centralized in one vessel permitting the use of a single fume abatement system rather than, as in the prior art, an elaborate fume collection duct system from multiple flakers or cooling belts over a large area. The present invention also provides an apparatus which is simple and compact in its construction and is versatile in its ability to meet scale-up requirements merely by using a larger drum and/or more balls, rather than utilizing a plurality of flaker machines and their associated equipment.

The foregoing description of the method and apparatus according to the prevent invention is merely illustrative of the principles of the invention. Other alternatives within the scope of one of ordinary skill in the art may be employed to accomplish various disclosed steps. Accordingly, the present invention is to be construed only in accordance with the following claims.

What is claimed is:

1. A method for efficiently solidifying solvent-refined coal comprising steps of:

providing solvent-refined coal in substantially liquid form at a temperature in the range of 200° to 600° F. and contacting said solvent-refined coal with dry, substantially inert, heat absorbent particulate solids, said solids being initially provided at a temperature less than 200° F. in a cooling zone within a rotating structure for a period of time to allow sufficient heat transfer from said solvent-refined coal to said solids, thereby forming a coating of solid solvent-refined coal on said solids;

separating said solid coating of solvent-refined coal from said solids:

collecting said separated solids and cooling same to a temperature at less than 200° F.

2. A method according to claim 1 further comprising the step of recycling said cooled solids in said method by contacting same with a fresh supply of solvent refined coal in substantially liquid form in said cooling zone.

3. A method according to claim 1 wherein said solids comprise ceramic balls of a diameter in the range of about 0.5 to 1.5 inch.

4. A method according to claim 3 wherein said solvent refined coal is initially provided at a temperature in the range of 350° to 450° F. and said solids are initially provided at a temperature in the range of 60° to 100° F.

5. A method according to claim 1 wherein said step of separating said solids from said coating comprises rotating said coated solids in a portion of said structure comprising a moving screened means whereby coal particles abraded from said solids pass through said screening means, said screening means having openings smaller than the size of said solids.

6. A method according to claim 5 further comprising the step of collecting vapors evolved from the solidification of said solvent-refined coal in a vapor-collecting zone and conducting said collected vapors away from said structure.

* * * * *